United States Patent [19]

Styles

[11] Patent Number: 4,826,225

[45] Date of Patent: May 2, 1989

[54] LOCKING SYSTEM FOR SLIDING PANELS

[76] Inventor: William G. Styles, 10244 Inversheil Ct., Mint Hill, N.C. 28212

[21] Appl. No.: 63,501

[22] Filed: Jun. 18, 1987

[51] Int. Cl.[4] ..... F05C 17/32

[52] U.S. Cl. ..... 292/338; 292/DIG. 46; 292/263; 292/305

[58] Field of Search ..... 292/338, 339, DIG. 46, 292/262, 263, 259 R, 305, 306; 70/90, 93, 94, DIG. 64; 49/124, 354, 356, 449, 50, 56, 57

[56] References Cited

U.S. PATENT DOCUMENTS

| | | | |
|---|---|---|---|
| 1,423,467 | 7/1922 | Spitzfaden | 292/262 |
| 1,631,772 | 6/1927 | Shelton | 292/305 |
| 2,584,713 | 2/1952 | Kanaval | 248/237 |
| 2,768,850 | 10/1956 | Minnis, Jr. | 292/338 |
| 3,471,189 | 10/1969 | Ness | 49/449 |
| 3,512,821 | 5/1970 | Savio et al. | 292/262 |
| 3,797,005 | 3/1974 | Schwarz | 70/94 |
| 4,295,676 | 10/1981 | Smith | 292/DIG. 46 |
| 4,302,038 | 11/1981 | Ervine | 292/263 |
| 4,461,502 | 7/1984 | Burgess | 292/DIG. 46 |
| 4,570,985 | 2/1986 | Waldo et al. | 292/DIG. 46 |

*Primary Examiner*—Gary L. Smith
*Assistant Examiner*—Eric K. Nicholson
*Attorney, Agent, or Firm*—Bell, Seltzer, Park & Gibson

[57] ABSTRACT

A locking system is disclosed for securing and locking sliding panels such as doors or windows of the type in which the opening and closing movement of a sliding panel occurs in a plane adjacent and generally perpendicular to a fixed surface which is substantially parallel to a side edge of the sliding panel. The system comprises first and second locking bars of predetermined fixed length for being positioned between one side edge of a sliding panel and one fixed surface opposite that side edge. First bracket means are mounted either upon the one side edge or upon the opposite fixed surface, and support one respective end of each of the first and second locking bars adjacent one another, and thereby maintain the ends against the side edge or the fixed surface. Second bracket means are mounted upon the other of the side edge or the opposite fixed surface, and support the other respective end of each of the locking bars in spaced relationship to one another. The second bracket means thereby maintain the ends in the spaced relationship, whereby the locking bars and the first and second bracket means form a triangularly braced barrier to movement of the sliding panel along the plane of movement thereof and a barrier to removal of the panel out of its plane of movement.

22 Claims, 2 Drawing Sheets

LOCKING SYSTEM FOR SLIDING PANELS

FIELD OF THE INVENTION

This invention relates to apparatus and methods for locking sliding panels such as sliding doors or windows against unwanted sliding movement and against removal from their normal planes of movement.

BACKGROUND OF THE INVENTION

Sliding panels such as doors or windows have been used in residential and business construction for some time, and a number of systems for securing them against unwanted entry have concurrently developed.

In recent decades, the structural improvement in and the increased availability of larger panels of glass supported by smaller and lighter metal frames, typically extruded aluminum or the like, has resulted in an increased use of door-size panels of glass carried in metal frames which are positioned and supported in surrounding metal frames or jambs in which a generally vertically extending glass panel is arranged for side-to-side horizontal movement in a vertical plane. Certain types of such sliding panels are often referred to as "sliding glass doors".

In one typical arrangement, two such door-size panels are mounted parallel to one another in a frame having a width approximately double that of the individual panels. One of the panels is usually fixed in place immediately adjacent one of the vertical frame members while the other is mounted in a track which runs along the top and bottom horizontal frame members. The movable panel can be slid to a position immediately behind the stationary panel, in which arrangement the other portion of the frame defines an open doorway. When the sliding panel is slid to a generally end-to-end relationship with the stationary panel, the entire system forms a closed door.

Such panel arrangements have become quite popular, particularly in residential construction and are widely found in individual homes, townhouses, condominiums, and apartment units.

Because the usual architectural reason for including such sliding doors in a residential unit is the resulting combination of a large, window-like expanse of glass combined with an easily formed entrance way, such sliding doors usually carry a minimum of excess hardware and generally only include rudimentary locking systems. These are generally not of the character of deadbolt or other more secure types of locks which are commonly in conjunction with hinged or other types of doors formed of wood, metal or composite materials.

Accordingly, such sliding glass panel doors typically provide the most convenient means of unwanted entry into a residential unit which has such doors and therefore represent a security risk as the point of least resistance to unwanted entry to a unit. Various sorts of security hardware have been made available to address this problem. One typical solution is to place a piece of wooden or metal doweling in the track of the sliding glass panel door which is vacant and behind the stationary glass panel door when the sliding door is in the closed position. Although such doweling will initially prevent movement of the sliding door, persons experienced at gaining unwanted entry are generally able to remove such doweling with relative ease by slipping a thin, flat, flexible entry tool between the frame and the doors and thereby dislodging of the dowel.

Another common technique is often used where the frames of the sliding and stationary doors overlap somewhat when the doors are in the closed position. In such cases, a set of aligned holes can be drilled in both frames and a nail or other cylindrical object inserted therein. As with the doweling in the track, such an arrangement will initially prevent unwanted opening of the sliding door. Once again, however, those experienced in gaining unwanted entry know that such nails can be easily dislodged by striking a hard blow to the outermost frame portion at the point where the nail is positioned, typically using a rubber mallet or the like. Because the frame members are held stationary by their structure and surrounding frame, the basic laws of physics dictate that the momentum generated by the delivered blow will be transferred to the removable nail which will literally fly out of the frames upon receipt of such a blow.

More recently, commercial locking mechanisms have appeared for such sliding glass panel doors. These generally take the form of some sort of bar which is mounted horizontally between one vertical edge of the sliding door and one vertical frame member. A number of such designs are available, but most attempt to secure a bar in a horizontal position between the sliding door and its frame in order to secure the door against unwanted entry.

Such commercial devices have failed to gain widespread use or acceptance. First, unless they are well-secured against the door edge and the frame, they can be removed just as easily as can a piece of doweling in the door track. Where secured in somewhat better fashion, such bars can often be dislodged using some sort of leverage tool such as a small crowbar. Other commercially available bars are formed of materials—even metals—which are of insufficient gauge or strength to resist serious entry and will literally bend in place when a sufficient opening force is applied to the sliding door. Typically, the force which can be exerted by a crowbar has proven to be enough to cause such single bars to buckle. It will be understood that, in providing unwanted entry, the sliding door only has to be opened to an extent sufficient for an intruder to pass through, and devices which allow such an extent of movement are essentially useless as security devices, even though they may typically prevent the door from sliding as fully or as freely as it could in their absence.

Finally, where an intruder seeks entry with a particularly serious intent, such horizontally placed individual bars typically cannot prevent the intruder from literally removing the sliding panel from its frame and gaining entry in that manner rather than by forcing the door to slide.

Accordingly, it is an object of the present invention to provide a locking system for securing sliding panels such as sliding glass doors which includes a plurality of locking bars against which an intruder would have to seek entry.

It is another object of the present invention to provide a locking system for sliding panels which maintains the end of the included locking bars securely against the edge of the sliding panel door and the edge of the door frame.

It is a further object of this invention to provide a set of bars and brackets which can form either a triangular or four-point braced barrier against sliding movement of a sliding panel.

It is another object of this invention to provide a locking system for sliding panel doors which makes removal of the door out of its plane of movement much more difficult than has been the case with previous locking systems.

It is a further object of this invention to provide a locking system which permits a sliding glass door to be locked as securely in several partially opened positions as it can be locked in a fully closed position so that ventilation and the like through the partially open door can be accomplished without sacrificing security.

It is another object of the invention to provide locking bars which are pivotally supported in the security system so as to increase the ease of use of such a system.

Finally, it is a further object of this invention to provide a security system which includes locking bars for sliding panel doors which can be optionally unlocked so as to allow full movement of the sliding panel door without removal of the locking system or of the locking bars.

SUMMARY OF THE INVENTION

The present invention comprises a locking system for securing and locking sliding panels such as doors or windows of the type in which the opening and closing movement of a sliding panel occurs in a plane adjacent and generally perpendicular to a fixed surface which is substantially parallel to a side edge of the sliding panel. The system comprises first and second locking bars of predetermined fixed length for being positioned between one side edge of a sliding panel and one fixed surface opposite that side edge. First bracket means are mounted either upon the one side edge or upon the opposite fixed surface, and support one respective end of each of the first and second locking bars adjacent one another, and thereby maintain the ends against the side edge or the fixed surface. Second bracket means are mounted upon the other of the side edge or the opposite fixed surface, and support the other respective end of each of the locking bars in spaced relationship to one another. The second bracket means thereby maintain the ends in the spaced relationship, whereby the locking bars and the first and second bracket means form a triangularly braced barrier to movement of the sliding panel along the plane of movement thereof and a barrier to removal of the panel out of the plane of movement.

The foregoing and other objects, advantages and features of the invention, and the manner in which the same are accomplished will become more readily apparent upon consideration of the following detailed description of the invention taken in conjunction with the accompanying drawings, which illustrate preferred and exemplary embodiments, and wherein.

DETAILED DESCRIPTION

Figure 1:
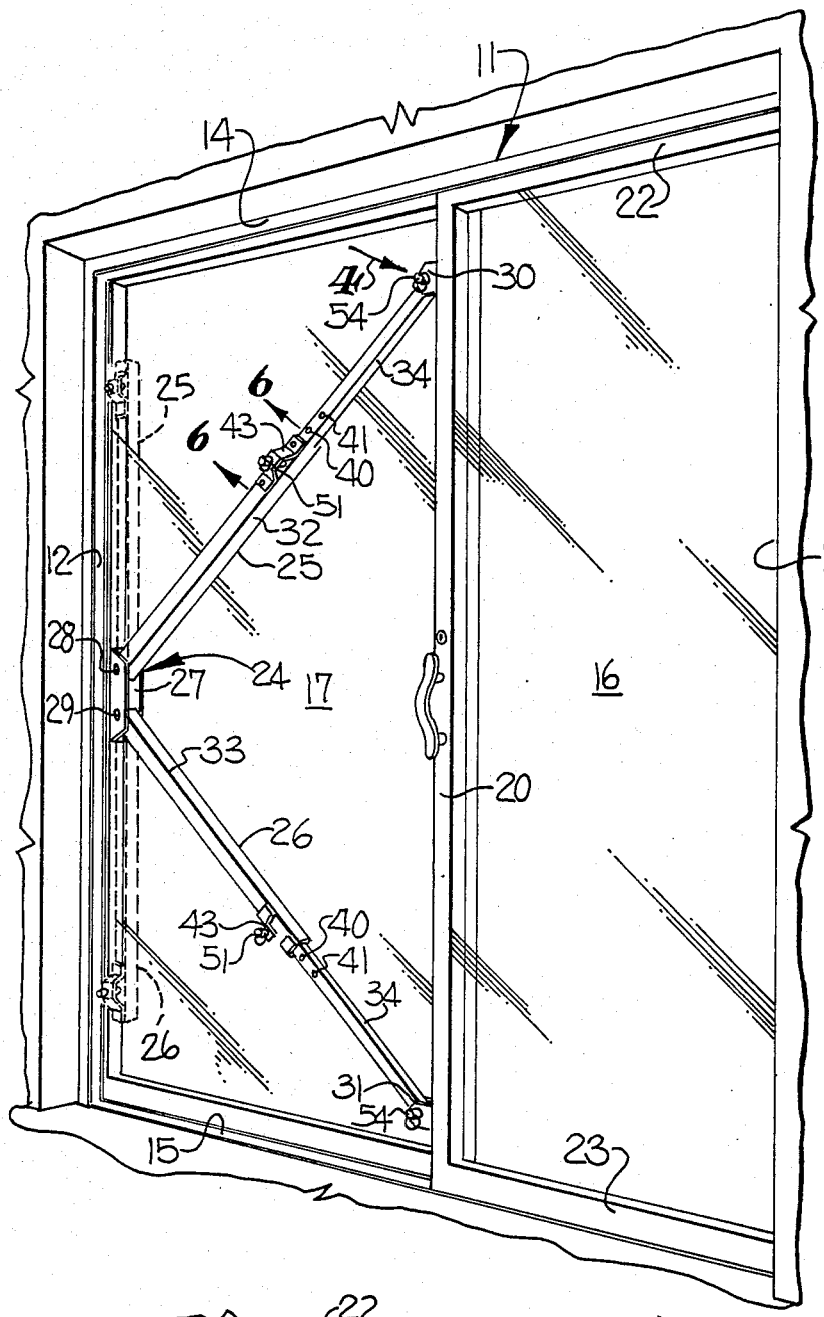
FIG. 1 is a perspective view of a typical set of sliding glass panel doors to which the locking system of the present invention has been added.

The combination of a sliding glass panel door, a stationary glass panel door, their frame and the invention are illustrated in FIG. 1 and broadly designated as 10. FIG. 1 shows a typical embodiment which includes a generally rectangular panel frame broadly designated 11 which is defined by respective vertical side frame members 12 and 13, and respective horizontal top and bottom frame members 14 and 15. The frame carries two panels of glass, the sliding panel 16 and a stationary panel 17. The sliding panel 16 is likewise defined by a panel frame housing two vertical side edges 20 and 21 and top and bottom horizontal edge members 22 and 23, respectively.

The locking system of the invention is broadly designated at 24. In its broadest sense, the system comprises first and second locking bars 25 and 26 of predetermined fixed length which are positioned between the one side edge 20 of the sliding panel 16 and a fixed surface opposite the side edge 20, which in the illustrations is the side vertical member 12 of the frame 11. As illustrated in FIG. 1, the bars 25 and 26 are in generally upper and lower positions respectively and comprise means for being adjusted to at least two predetermined fixed lengths.

The bars 25 and 26 are respectively supported in first and second bracket means which can respectively be mounted either upon the one side edge 20 of the sliding glass panel 16 or upon the opposite fixed surface represented by the side vertical frame member 12. In FIG. 1, the first bracket means is shown as the common bracket 27 which supports one respective end of each of the upper and lower locking bars 25 and 26 adjacent one another in the bracket 27 and thereby maintains the ends against the side vertical member 12. The other respective ends of each of the bars 25 and 26 are supported in second bracket means which, as it will be understood, are mounted on the other of either the fixed surface or the edge of the sliding panel. In the illustration, the second bracket means are represented by the upper individual bracket 30 and the lower individual bracket 31. Brackets 30 and 31 are mounted in spaced relationship to one another and likewise maintain the other ends of the bars 25 and 26 against the side vertical edge 20 of the sliding glass panel 16.

As a result, the locking bars 25 and 26, the common bracket 27, the individual brackets 30 and 31 all form a triangularly braced barrier to movement of the sliding panel 16 along the plane of movement. Just as importantly, the triangularly braced barrier also poses a significant barrier to removal of the sliding glass panel door 16 out of its plane of movement.

For example, because th locking system secures the door at a minimum of three points, pivoting the door in any fashion is rendered quite difficult, if not impossible. Additionally, and as is known to those familiar with structural engineering, a triangle is the only structural geometry which cannot be deformed so long as the lengths of its sides remain fixed. Triangular structures thus provide particular strength and stability for any given material used and triangular structures form the basis of all sorts of variations of trusses and the like.

Figure 2:
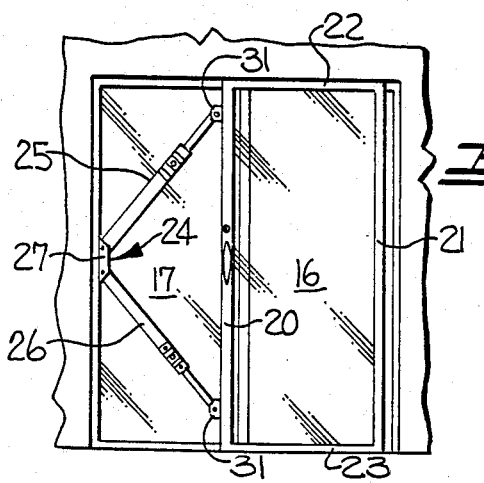
FIG. 2 is a side elevational view of the sliding glass panel doors of the invention of FIG. 1 in a first partially opened and secured position.
Figure 3:
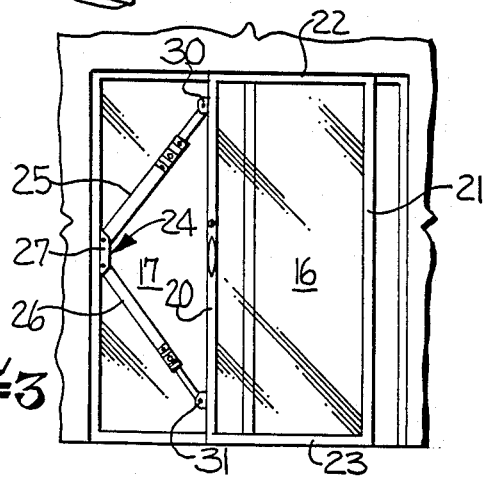
FIG. 3 is another side elevational view identical to FIG. 2, but showing the sliding door and invention in a second partially opened and secured position.

In addition to providing a basic, triangularly braced barrier, the present invention includes several other features which make it particularly useful as a security device. First, as is illustrated in FIGS. 1, 2 and 3, in a preferred embodiment the upper and lower locking bars 25 and 26 are each formed from respective first telescoping members 32 and 33 and second telescoping members 34 and 35. The telescoping members 25 and 26 have generally rectangular cross sections and are formed of metal, extruded aluminum being typical.

Figure 6:
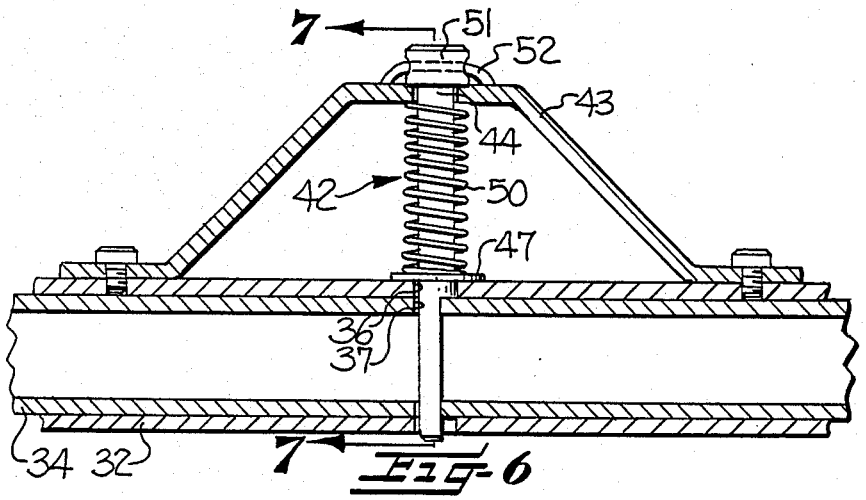
FIG. 6 is an enlarged cross-sectional view taken along lines 6—6 of FIG. 1.
Figure 7:
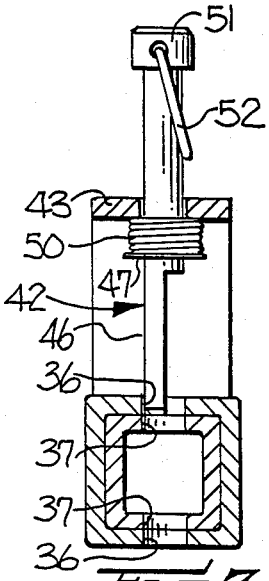
FIG. 7 is a cross-sectional view taken along lines 7—7 of FIG. 6.

This embodiment of the invention further includes means for releasably locking the upper and lower telescoping bars 25 and 26 in at least two different predetermined fixed lengths. As best illustrated in FIG. 6 and 7, the means for releasably locking the upper and lower locking bars 25 and 26 in their respective different predetermined fixed lengths comprises a pair of aligned holes 36 in each of the first telescoping members 32 and 33 and a plurality of pairs of aligned holes in each of the second telescoping members 34 and 35. These are designated in FIGS. 6 and 7 as 37, and additional pairs of aligned holes in the respective second telescoping members 34 and 35 are also illustrated as 40 and 41 in FIG. 1 and FIG. 8. A pin broadly designated at 42 in FIGS. 6 and 7 is concurrently received in the aligned holes 36 in the first telescoping member 32 or 33 and in one of the sets of aligned holes in the respective second telescoping members 34 and 35.

As best illustrated in FIGS. 6 and 7, in a preferred embodiment of the invention the pin 42 is also supported and aligned in an outwardly extending bracket 43 which is carried on first telescoping member 32. The bracket 43 straddles the aligned holes 36 in the first telescoping member 32 and includes a hole 44 which is aligned with holes 36 and which can likewise be aligned with the holes 37 in telescoping member 34 when the telescoping members 34 and 32 are in the proper position.

In the illustrated embodiment, pin 42 contains an upper section 45, a lower section 46, a collar 47, a spring 50, a cap 51, and a ring 52. The upper section 45 is larger in diameter than the lower section 46 and in a preferred embodiment has a D-shaped cross-section. When the telescoping bars are locked in a fixed predetermined length as illustrated in FIG. 6, the spring 50 which is disposed between the bracket 43 and the first telescoping member 32 biases the entire pin 42 into an aligned position where it is concurrently received in aligned pairs of holes 36 and 37, thereby locking telescoping members 32 and 34 into their fixed predetermined lengths.

When a change in the predetermined fixed length of the locking bars 25 and 26 is desired or required, the pin can be moved to the position shown in FIG. 7 in which the lip formed by the difference in diameters of upper and lower pin portions 45 and 46 rests on the side of the hole 44 in bracket 43, thus maintaining pin 42 out of engagement with the telescoping members 32 and 34 and allowing them to telescope freely with respect to one another. The ring 52 permits the pin to be easily engaged, for example by a person's finger, for movement in the manner described.

As seen in FIGS. 2 and 3, because the bars 25 and 26 can be locked at different predetermined fixed lengths, the sliding glass panel 16 can be securely locked in one or more partially opened positions depending upon number of pairs of aligned holes selectively added to the telescoping members 34 and 35.

In order to further facilitate the use of the locking bars at different fixed lengths, the respective ends of the bars 25 and 26 are pivotally supported in the common bracket 27 and likewise pivotally supported in the individual brackets 30 and 31. As will be apparent from FIGS. 1, 2 and 3, with the bars pivotally supported, they need not be removed in order for their lengths to be adjusted or the door to be repositioned. Rather, the pins 42 in each of the bars 25 and 26 can be moved to their respective unlocked positions and the sliding panel 16 moved as desired. As the sliding glass panel door 16 is moved, the bars 25 and 26 pivot in the brackets 27, 30 and 31 and the respective second telescoping members 34 and 35 telescope into or out of the respective first telescoping members 32 and 33. The sliding glass panel door 16 can be locked in any partially open position which is defined by an alignment of the holes 36 in the respective first telescoping members 32 and 33 with the holes 37, 40 or 41 in the respective second telescoping members 34 and 35. As a further advantage of the present invention, the pivoting and telescoping cooperation of the bars and the brackets permits the sliding glass panel 16 to be moved to fully open and fully closed positions at will wile the locking system 24 remains in place.

Figure 4:
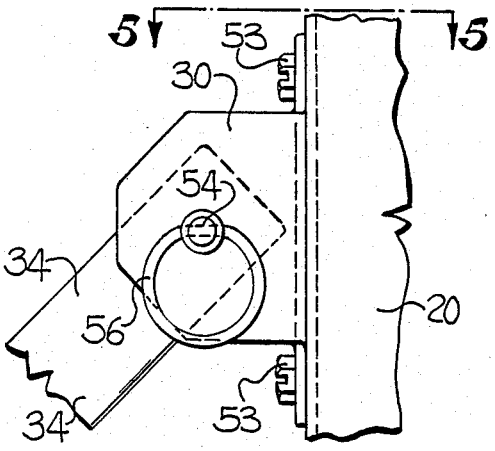
FIG. 4 is an enlarged, partial elevational view taken from line 4 of FIG. 1 and showing one of the brackets of the present invention.
Figure 5:
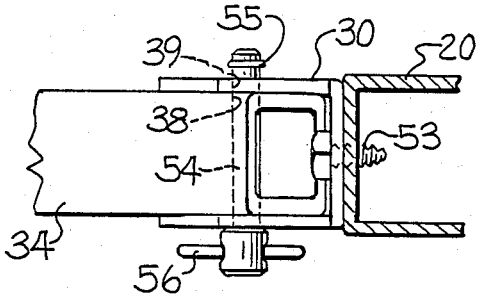
FIG. 5 is a plan view taken along lines 5—5 of FIG. 4.

The means of accomplishing the pivotal support of the brackets is illustrated in FIGS. 4 and 5 with respect to the individual bracket 30, and it will be understood that the pivotal support of the other individual bracket 31 and of the common bracket 27 function in an identical manner. FIG. 4 shows the side vertical edge 20 of the sliding glass panel door 16. The upper independent bracket 30 is mounted on the frame 20 using fastening screws 53. One end of the telescoping member 34 is supported in the bracket 30 and the same is accomplished by providing a pair of aligned holes 38 in the member 34 adjacent its end and a similar set of aligned holes 39 in upper independent bracket 30. As illustrated in FIG. 5, another pin 54 is received through the aligned holes in the bracket 30 and the end of the telescoping member 34 and permits rotation of the telescoping member 34 about an axis defined by the axis of the pin 54 while preventing telescoping member 34 from being undesirably removed from bracket 30. The pin 54 includes a collar spring 55 and a grasp ring 56 so that it can be removed from the aligned holes when desired, but cannot be removed inadvertently or by application of indirect force or exterior momentum.

Although the common bracket 27 is not shown in an enlarged view, it pivotally supports the other respective ends of the locking bars 25 and 26 in a manner identical to that described with respect to bracket 30. In a preferred embodiment, both the individual and common brackets are formed of metal, usually the same as the locking bars. The brackets have generally U-shaped cross-sections formed from a web and parallel legs extending therefrom. The common bracket 27 has a first pair of aligned holes 28 in upper portions of the legs, and a second pair of aligned holes 29 in lower portions of the legs. The telescoping members 32 and 33 each have a similar pair of aligned holes (not visible in FIG. 1) near their respective other ends. A first pin (not shown), which may be similar in all respects to the pin 56 described previously extends through the upper pairs of holes 28 and pivotally supports upper locking bar 25 in the common bracket 27 and a second pin extends through the second pair of holes 29 and through the aligned set of holes in the other respective end of locking bar 26.

Although all of the pins are secure against undesired removal by an intruder operating outside of the panels 16 and 17, they can be removed as desired from inside the panels and thus provide the means for releasably locking the bars in place. The system of pins and brackets results in a security device which offers tremendous flexibility in the manner in which a sliding glass door can be locked while at the same time provides for particular ease of removal of the locking bars from the system when such is desired, usually for aesthetic reasons when the door need not be locked.

Figure 8:
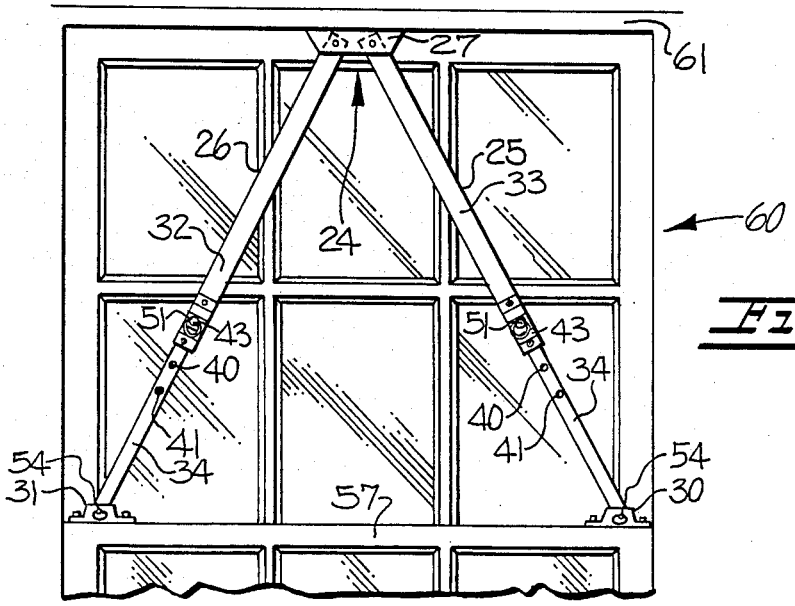
FIG. 8 is a side elevational view of the invention positioned to secure a typical double-hung window.

FIG. 8 illustrates another manner of using the locking system of the present invention, and for the sake of clarity and simplicity, all reference numerals will be used in a manner identical to the description with respect to the sliding door. As seen in FIG. 8, the locking system 24 is positioned adjacent the upper portion of a sliding, double-hung window 60. The common bracket 27 is positioned against an upper horizontal member 61 of the window frame, and the individual brackets 30 are positioned on the upper horizontal portion of a window sash 57. The adjustable locking bars 25 and 26 are pivotally received in the brackets 27, 30 and 31 and form an adjustable three-point barrier to movement of the sash 57 within its plane of movement, and against unwanted removal of the sash 57 from the window frame. It will be understood that the operation of the locking system 24 is in all other respects identical to its use with respect to sliding glass doors.

In the drawings and specification, there have been disclosed typical preferred embodiments of the invention, and, although specific terms are employed, they are used in a generic and descriptive sense only and not for purposes of limitation, the scope of the invention being set forth in the following claims.

What is claimed is:

1. A locking system for securing and locking sliding panels such as doors or windows of the type in which the opening and closing movement of a sliding panel occurs in a plane adjacent and generally perpendicular to a fixed surface which is substantially parallel to a side edge of the sliding panel, said system comprising:

first and second locking bars of predetermined fixed length for being positioned between one side edge of a sliding panel and one fixed surface opposite said one side edge other than an adjacent sliding panel;

first bracket means for being mounted either upon said one side edge or upon said one opposite fixed surface, and for supporting one respective end of each of said first and second locking bars adjacent one another in said first bracket means and to thereby maintain said ends against said side edge or said fixed surface; and second bracket means for being mounted upon the other of said one side edge or said one opposite fixed surface, and for such porting the other respective end of each of said locking bars in spaced relationship to one another and to thereby maintain said ends against said side edge or said fixed surface in said spaced relationship, whereby said locking bars, said first bracket means and said second bracket means form a barrier to movement of said sliding panel along the plane of movement thereof which secures said sliding panel at three points that form a substantially triangular profile therebetween, and a barrier to removal of said panel out of said plane of movement.

2. A locking system according to claim 1 wherein said first bracket means comprises a common bracket for supporting one respective end of each of said locking bars.

3. A locking system according to claim 1 wherein said second bracket means comprises an individual bracket corresponding to each of said first and second locking bars for being mounted in spaced relationship to one another upon the other of said one side edge or said one opposite fixed surface.

4. A locking system according to claim 1 further comprising means for adjusting said first and second locking bars to at least two predetermined fixed lengths whereby the substantially triangular barrier can secure a sliding panel in more than one locked position.

5. A locking system according to claim 1 wherein said first bracket means further comprises means for releasably locking said respective ends of said first and second locking bars adjacent one another in said first bracket means.

6. A locking system according to claim 1 wherein said second bracket means further comprises means for releasably locking said other respective end of said first or second locking bar in said second bracket means.

7. A locking system according to claim 1 and wherein:

said second bracket means comprises a pair of individual brackets corresponding to each of said first and second locking bars for being mounted in spaced relationship to one another adjacent the sliding edges of a sliding panel; and said first bracket means comprises a common bracket for being mounted on said fixed surface, and generally centrally thereon with respect to the spaced relationship of said individual brackets and for supporting one respective end of each of said locking bars therein, whereby said generally centrally positioned common bracket, said spaced individual brackets and said locking bars form a substantially triangular barrier to movement of said panel along the plane of movement thereof and a barrier to removal of a panel out of its plane of movement.

8. A locking system according to claim 1 wherein said respective ends of said locking bars supported in said first bracket means are supported at a fixed relationship to one another.

9. A locking system for securing and locking sliding doors of the type in which the horizontal opening and closing movement of at least one sliding door occurs in a vertical plane between and perpendicular to opposite fixed vertical surfaces which are parallel to the vertical side edges of the sliding door, said system comprising:

upper and lower locking bars for being adjustably positioned between one vertical side edge of a sliding door and one vertical fixed surface opposite said one side edge other than an adjacent sliding door, and each of said upper and lower locking bars comprising respective first and second telescoping members;

means for releasably locking each of said upper and lower locking bars in at least two different predetermined fixed lengths;

a common bracket for being mounted either upon said one side edge or upon said one opposite fixed surface, and having means for supporting and releasably locking one respective end of each of said upper and lower bars to said common bracket and adjacent one another, and to thereby maintain said ends against said vertical side edge or said one vertical fixed surface, an individual bracket corresponding to each locking bar for being mounted in vertically spaced relationship to one another upon the other of said one vertical side edge or said one opposite vertical fixed surface, and having means for individually supporting and releasably locking the other respective end of one of said locking bars to said individual bracket, and to thereby maintain said end against said side edge or said fixed surfaces whereby said locking bars, said common bracket and said individual brackets form a releasably locking barrier to movement of said sliding door along the plane of movement thereof which secure said sliding door at three points that form a substantially triangular profile therebetween and a barrier to removal of said door out of said plane of movement.

10. A locking system according to claim 9 wherein said means for releasably locking said upper and lower locking bars in different predetermined fixed lengths comprises a pair of aligned holes in each of said first telescoping members, a plurality of pairs of aligned holes in each of said second telescoping members, and a pin for being concurrently received in said aligned holes in said first telescoping member and in one said pair of aligned holes in said second telescoping member.

11. A locking system according to claim 9 wherein said common bracket has a generally U-shaped cross-section formed from a web and parallel legs extending therefrom and wherein said means for releasably locking said respective ends of said upper and lower locking bars to said common bracket comprises a first pair of aligned holes in upper portions of said legs;

a second pair of aligned holes in lower portions of said legs;

a pair of aligned holes in the end of each of said upper and lower locking bars received in said common bracket;

a first pin extending through said first pair of holes and through said aligned holes in said end of said upper locking bar; and a second pin extending through said second pair of holes and through said aligned holes in said end of said lower locking bar.

12. A locking system according to claim 9 wherein each said one of said locking bars pivotally supported in said common bracket.

13. A locking system according to claim 9 wherein each said other end of said locking bars is pivotally supported in each said individual bracket.

14. A sliding door or window construction having provision for locking the same against unwanted sliding movement or removal, and comprising:

a generally rectangular panel frame defined by respective vertical side frame members and respective horizontal top and bottom frame members;

a generally rectangular sliding panel slidably positioned within said panel frame for movement between respective opposite frame members in said panel frame, with said sliding panel including four side edges;

first and second locking bars of predetermined fixed length positioned between one side edge of said sliding panel and said frame member opposite said one side edge;

a common bracket mounted upon the said frame member opposite said one side edge and supporting one respective end of each of said first and second locking bars adjacent one another in said common bracket and to thereby maintain said ends against said frame member;

an individual bracket corresponding to each locking bar mounted upon said one side edge of said sliding panel, and individually supporting the other respective end of each of said locking bars in spaced relationship to one another and to thereby maintain said ends against said one side edge, whereby said locking bars, said common bracket and said individual brackets form a barrier to movement of said panel along the plane of movement thereof which secures said sliding panel at three points that form a substantially triangular profile therebetween and a barrier to removal of said panel out of said plane of movement.

15. A construction according to claim 14 in which said first and second locking bars are adjustable to at least two predetermined fixed lengths whereby the triangularly braced barrier can secure a sliding panel in more than one position.

16. A construction according to claim 14 wherein said common bracket further comprises means releasably locking said respective ends of said first and second locking bars adjacent one another in said common bracket.

17. A construction according to claim 14 wherein each said individual bracket further comprises means releasably locking said other respective end of said first or second locking bar in said individual bracket.

18. A construction according to claim 15 wherein each of said locking bars is adjustable to alternative fixed lengths and comprises:

respective first and second telescoping members;

a pair of aligned holes in each of said first telescoping members;

a plurality of pairs of aligned holes in each of said second telescoping members; and a pin for being concurrently received in said holes in said first telescoping member and in one said pair of aligned holes in said second telescoping member and for fixing the position of said first and second telescoping members with respect to one another and thereby fixing the length of said locking bar.

19. A construction according to claim 14 wherein said common bracket has a generally U-shaped cross-section formed from a web and parallel legs extending therefrom and wherein said means releasably locking said respective ends of said upper and lower locking bars to said common bracket comprises a first pair of aligned holes in upper portions of said legs;

a second pair of aligned holes in lower portions of said legs;

a pair of aligned holes in the end of each of said upper and lower locking bars received in said common bracket;

a first pin extending through said first pair of holes and through said aligned holes in said end of said upper locking bar; and a second pin extending through said second pair of holes and through said aligned holes in said end of said lower locking bar.

20. A construction according to claim 18 wherein said telescoping members have generally rectangular cross sections.

21. A construction according to claim 14 wherein said first and second locking bars are formed of metal.

22. A construction according to claim 14 further comprising means for releasing said locking bars from their respective fixed positions to permit said locking bars to pivot while said locking bars otherwise remain maintained in said common bracket and said individual brackets, and to thereby permit the sliding panel to move along the plane of movement with said locking bars releasably maintained in said brackets.

* * * * *

UNITED STATES PATENT AND TRADEMARK OFFICE

CERTIFICATE OF CORRECTION

PATENT NO. : 4,826,225

DATED : May 2, 1989

INVENTOR(S) : William G. Styles

It is certified that error appears in the above-identified patent and that said Letters Patent is hereby corrected as shown below:

Column 1, line 47, "entrance way" should be --entranceway--.

Column 6, line 27, "wile" should be --while--.

Column 7, line 61, "such porting" should be --supporting--.

Column 9, line 3, after the word "lower", please insert the work --locking--.

Column 9, line 15, "surfaces" should be --surface--.

Column 9, line 19, "secure" should be --secures--.

Column 9, line 53, after the word "one", please insert the word --end--.

Signed and Sealed this

Twenty-second Day of May, 1990

*Attest:*

HARRY F. MANBECK, JR.

*Attesting Officer*

*Commissioner of Patents and Trademarks*